US009802627B2

(12) United States Patent
Nishimura et al.

(10) Patent No.: US 9,802,627 B2
(45) **Date of Patent: *Oct. 31, 2017**

(54) RAILCAR BOGIE

(71) Applicant: KAWASAKI JUKOGYO KABUSHIKI KAISHA, Kobe-shi, Hyogo (JP)

(72) Inventors: Takehiro Nishimura, Kobe (JP); Shunichi Nakao, Kobe (JP); Yasufumi Okumura, Kobe (JP); Shintaro Ando, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 125 days.

This patent is subject to a terminal disclaimer.

(21) Appl. No.: 14/759,627

(22) PCT Filed: Jan. 6, 2014

(86) PCT No.: PCT/JP2014/000006

§ 371 (c)(1),
(2) Date: Jul. 7, 2015

(87) PCT Pub. No.: WO2014/109280

PCT Pub. Date: Jul. 17, 2014

(65) Prior Publication Data

US 2015/0344047 A1 Dec. 3, 2015

(30) Foreign Application Priority Data

Jan. 10, 2013 (JP) ..... 2013-002735

(51) Int. Cl.
*B61F 5/30* (2006.01)
*B61F 5/52* (2006.01)
(Continued)

(52) U.S. Cl.
CPC ..... *B61F 5/30* (2013.01); *B61C 9/50* (2013.01); *B61F 3/04* (2013.01); *B61F 5/10* (2013.01);
(Continued)

(58) Field of Classification Search
CPC .... B61F 5/30; B61F 5/302; B61F 5/52; B61F 5/50; B61F 5/523; B61F 3/04; B61F 5/12;
(Continued)

(56) References Cited

U.S. PATENT DOCUMENTS 221,036 A * 10/1879 Davis ..... B61F 5/302 105/197.05
1,681,303 A * 8/1928 Martin ..... B61F 5/06 105/197.1
6,338,300 B1 * 1/2002 Landrot ..... B61F 5/305 105/182.1

FOREIGN PATENT DOCUMENTS

JP S55-47950 A 4/1980
JP 2799078 B2 9/1998
(Continued)

OTHER PUBLICATIONS

Mar. 4, 2014 Search Report Issue in International Application No. PCT/JP2014/000006.

*Primary Examiner* — Mark Le
(74) *Attorney, Agent, or Firm* — Oliff PLC

(57) ABSTRACT

A railcar bogie includes: a cross-beam supporting a carbody; pair of axles at both cross-beam sides in car longitudinal direction and extending in car-width direction; bearings at both car-width direction sides of each axle and rotatably supporting axles; axle-boxes accommodating respective bearings; plate-springs supporting both car-width direction end-portions of the cross-beam and extending in car longitudinal direction, both car longitudinal direction end-por-
(Continued)

tions of each plate-springs supported by axle-boxes; pressing members at both car-width direction end-portions of the cross-beam placed on respective car longitudinal direction middle-portions of plate-springs, lower surface of a portion of each pressing member having a convex downward circular-arc shape in side-view, the portion pressing the plate-spring, a middle-portion upper surface of each plate-spring having convex downward circular-arc shape in side-view, the middle-portion pressed by the pressing member, and a lower surface curvature of the pressing member larger than the upper surface curvature of the middle plate-spring portion.

9 Claims, 10 Drawing Sheets

(51) Int. Cl.

| | |
|---|---|
| ***B61F 3/04*** | (2006.01) |
| ***B61F 5/10*** | (2006.01) |
| ***B61C 9/50*** | (2006.01) |

(52) U.S. Cl.
CPC ..... *B61F 5/302* (2013.01); *B61F 5/305* (2013.01); *B61F 5/52* (2013.01)

(58) Field of Classification Search
CPC .. B61F 5/305; B61F 5/32; B61F 5/325; B61F 3/02; B61F 5/06; B61F 5/26; B61F 5/301; Y02T 30/38; F16F 1/18; F16F 1/368
USPC ..... 105/197.1
See application file for complete search history.

(56) References Cited

FOREIGN PATENT DOCUMENTS

| | | | | |
|---|---|---|---|---|
| JP | 2012-116279 | A | | 6/2012 |
| JP | 2013-035536 | A | | 2/2013 |
| WO | WO2013/008468 | | * | 1/2013 |
| WO | 2013/038673 | A1 | | 3/2013 |

* cited by examiner

RAILCAR BOGIE

TECHNICAL FIELD

The present invention relates to a bogie supporting a carbody of a railcar.

BACKGROUND ART

A bogie for supporting a carbody of a railcar and allowing the railcar to run along a rail is provided under a floor of the carbody. In the bogie, axle boxes each configured to accommodate a bearing for supporting a wheelset are supported by axle box suspensions so as to be displaceable relative to a bogie frame in an upper/lower direction. For example, PTL 1 proposes an axle box suspension, and a bogie frame includes a cross beam extending in a lateral direction and a pair of left and right side sills extending from both respective end portions of the cross beam in the front/rear direction. The axle box suspension includes axle springs constituted by coil springs each provided between the axle box and the side sill located above the axle box. PTL 2 proposes a bogie including a bogie frame from which side sills are omitted.

CITATION LIST

Patent Literature

PTL 1: Japanese Patent No. 2799078
PTL 2: Japanese Laid-Open Patent Application Publication No. 55-47950

SUMMARY OF INVENTION

Technical Problem

In the bogie of PTL 1, the bogie frame constituted by the cross beam and the side sills is produced by welding heavy steel members to one another. Therefore, problems are that the weight of the bogie frame becomes heavy, and the cost for the steel members and the assembly cost become high.

In the bogie of PTL 2, the cross beam of the bogie frame and the axle box are connected to each other by a support mechanism member such that a certain distance between the cross beam of the bogie frame and the axle box is maintained. In addition, front/rear direction middle portions of plate springs are held by and fixed to both respective lateral direction end portions of the cross beam, and both front/rear direction end portions of each of the plate springs are inserted into respective spring receivers provided under the respective axle boxes. With this, according to the bogie of PTL 2, omitting the side sills from the bogie frame is realized.

However, according to the bogie of PTL 2, square tubular attaching portions are provided at both respective lateral direction end portions of the cross beam, and the front/rear direction middle portions of the plate springs are inserted through respective hollow portions of the attaching portions. Then, each of the plate spring is positioned and fixed by arranging a spacer in a gap between the attaching portion and the plate spring. Therefore, problems are that the structure of the bogie is complex, and assembly workability is not good. When an occupancy rate of a car is low, reducing the spring constant of the plate spring improves a ride quality. In contrast, when the occupancy rate of the car is high, a downward load applied to the bogie frame is high, so that the spring constant of the plate spring is desired to be high for supporting the downward load. Thus, a problem is that maintaining the good ride quality regardless of the change in the occupancy rate is difficult.

An object of the present invention is to provide a bogie whose assembly workability is improved by simplifying a configuration thereof and whose ride quality is good even if an occupancy rate changes.

Solution to Problem

A railcar bogie according to the present invention includes: a cross beam supporting a carbody of a railcar; a pair of axles arranged at both respective sides of the cross beam in a car longitudinal direction and extending in a car width direction; bearings provided at both car width direction sides of each of the axles and rotatably supporting the axles; axle boxes accommodating the respective bearings; plate springs supporting both respective car width direction end portions of the cross beam and extending in the car longitudinal direction, both car longitudinal direction end portions of each of the plate springs being supported by the respective axle boxes; and pressing members located at both respective car width direction end portions of the cross beam and placed on respective car longitudinal direction substantially middle portions of the plate springs, a lower surface of a portion of each of the pressing members having a circular-arc shape that is convex downward in a side view, the portion pressing the plate spring, an upper surface of a portion of each of the plate springs having the circular-arc shape that is convex downward in the side view, the portion being pressed by the pressing member, and a curvature of the lower surface of the pressing member being larger than the curvature of the upper surface of the plate spring.

According to the above configuration, the pressing members provide at both respective car width direction end portions of the cross beam are placed on respective car longitudinal direction middle portions of the plate springs from above. Therefore, a support structure between the plate spring and the cross beam is simplified, and assembly workability of the bogie significantly improves. Further, the curvature of the lower surface of the portion of the pressing member which presses the plate spring is larger than the curvature of the upper surface of the portion of the plate spring which is pressed by the pressing member. Therefore, as the number of passengers in the car increases, and this increases the downward load applied to the cross beam, the curvature of the portion of the plate spring which is pressed by the pressing member increases by the elastic deformation of the plate spring, and therefore, an area of the plate spring which is pressed by the pressing member increases. With this, a distance from a pressed region of the plate spring which is pressed by the pressing member to a supported region of the plate spring which is supported by the axle box shortens. Thus, the spring constant of the plate spring increases. Therefore, the car in which the spring constant changes in accordance with the change in the occupancy rate and which has good ride quality both when the occupancy rate is low and when the occupancy rate is high is realized.

According to the above configuration, the curvature of the lower surface of the pressing member is larger than the curvature of the upper surface of the plate spring. Therefore, a space is formed between the lower surface of the pressing member and the upper surface of the middle portion of the plate spring so as to be located at both longitudinal direction sides of a lowermost end of the pressing member. With this, even in a case where a difference in height between the front and rear wheels is generated by, for example, track irregularity, the portion of the lower surface of the pressing member which presses the upper surface of the plate spring is moved in a longitudinal direction of the plate spring. Thus, the followability to the track can be improved. With this, a wheel load variation due to the track irregularity and the like can be suppressed, and the running safety can be improved. In addition, the swinging of the cross beam can be suppressed, so that the ride quality can be prevented from deteriorating.

Advantageous Effects of Invention

As is clear from the above explanations, the present invention can provide a bogie whose assembly workability is improved by simplifying the configuration thereof and whose ride quality is good even if an occupancy rate changes.

DESCRIPTION OF EMBODIMENTS

Hereinafter, embodiments will be explained in reference to the drawings.

First Embodiment

Figure 1:
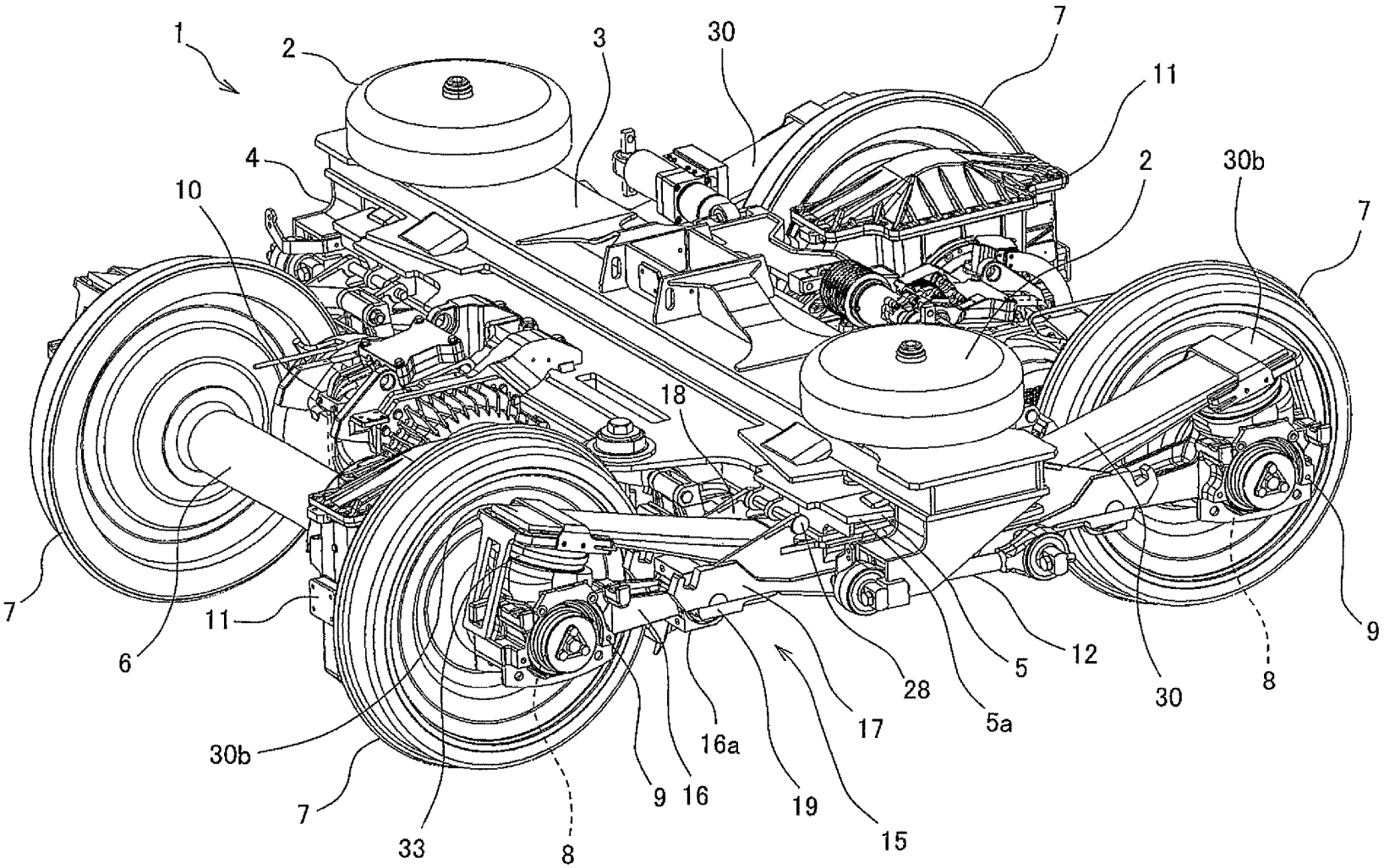
FIG. 1 is a perspective view showing a railcar bogie according to a first embodiment.
Figure 2:
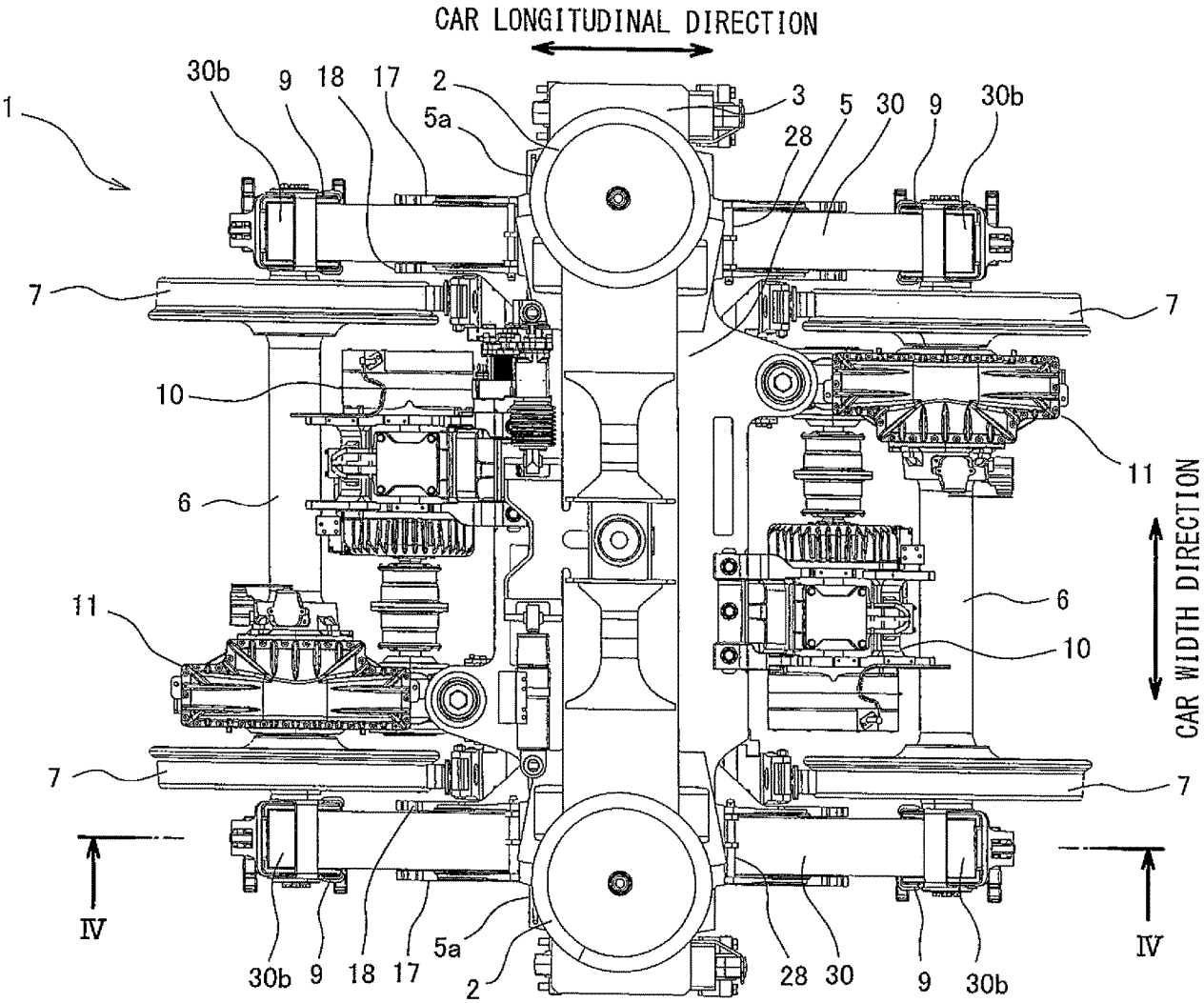
FIG. 2 is a plan view of the bogie shown in FIG. 1.
Figure 3:
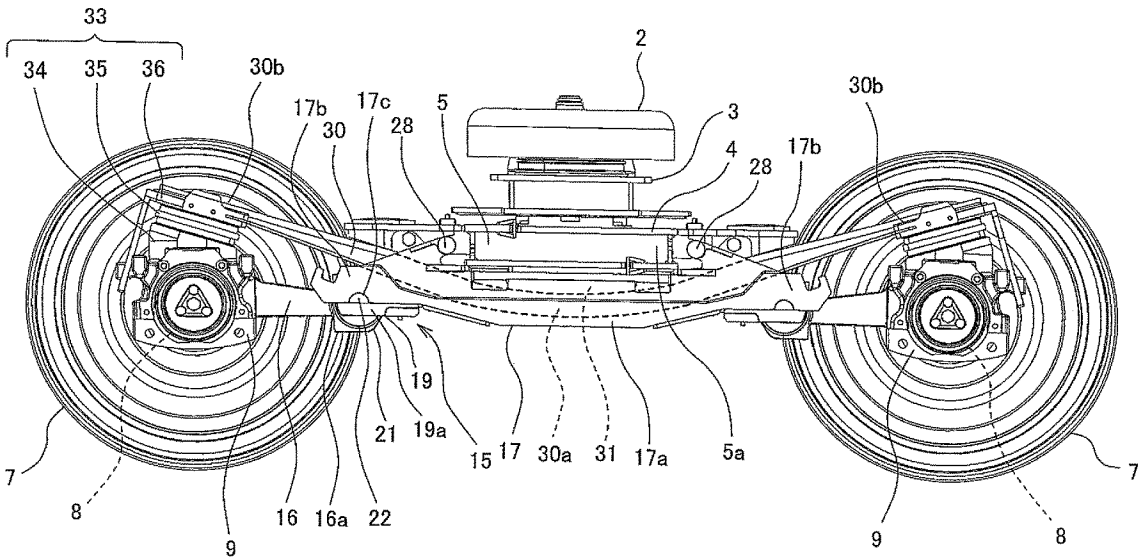
FIG. 3 is a side view of the bogie shown in FIG. 1 (an electric motor, a reducer, and the like are not shown).

FIG. 1 is a perspective view showing a railcar bogie 1 according to the first embodiment. FIG. 2 is a plan view of the bogie 1 shown in FIG. 1. FIG. 3 is a side view of the bogie 1 shown in FIG. 1. As shown in FIGS. 1 to 3, the bogie 1 for a railcar includes a bogie frame 4. The bogie frame 4 supports a carbody (not shown) via air springs 2 and a bolster 3, the air springs 2 serving as secondary suspensions. The bogie frame 4 includes a cross beam 5. The cross beam 5 extends in a car width direction that is a left/right direction and supports the carbody. However, the bogie frame 4 does not include side sills which extend from both respective car width direction end portions of the cross beam 5 in a car longitudinal direction that is a front/rear direction.

The cross beam 5 is connected to the bolster 3 via a center plate (not shown) and a center pin (not shown) so as to be able to swivel. The bolster 3 is connected to the carbody (not shown) via the air springs 2 and bolster anchors 12. A pair of front and rear axles 6 are respectively arranged in front of and behind the cross beam 5 so as to extend in the car width direction. Wheels 7 are fixed to both respective car width direction sides of each axle 6. Bearings 8 are provided at both respective car width direction end portions of each axle 6 so as to be located outside the wheels 7 in the car width direction. The bearings rotatably support the axles 6. The bearings 8 are accommodated in respective axle boxes 9. Electric motors 10 are attached to the cross beam 5. Gear boxes 11 are connected to respective output shafts of the electric motors 10. Each of the gear boxes 11 accommodates reduction gears which transmit power to the axle 6.

Each of plate springs 30 extending in the car longitudinal direction is provided between the cross beam 5 and the axle box 9. Longitudinal direction middle portions 30*a* of the plate springs 30 support both respective car width direction end portions 5*a* of the cross beam 5. Both longitudinal direction end portions 30*b* of each of the plate springs 30 are supported by the respective axle boxes 9. To be specific, each of the plate springs 30 serves as both a primary suspension and a conventional side sill. The plate springs 30 are made of, for example, fiber-reinforced resin, and the middle portions 30*a* of the plate springs 30 are arranged under the cross beam 5. Pressing members 31 are provided under the respective car width direction end portions 5*a* of the cross beam 5. Each of the pressing members 31 is provided between a pair of receiving seats 17 and 18 and has a circular-arc lower surface 31*b* (see FIG. 4). The pressing members 31 are disposed on the respective middle portions 30*a* of the plate springs 30 from above. To be specific, the pressing members 31 press respective upper surfaces of the plate springs 30 by a downward load from the cross beam 5 due to gravity so as not to fix the plate springs 30 in the upper/lower direction.

Spring seats 33 are attached to respective upper portions of the axle boxes 9. The end portions 30*b* of the plate springs 30 are disposed on the respective spring seats 33 from above. To be specific, the end portions 30*b* of each of the plate springs 30 are supported by the respective axle boxes 9 via the respective spring seats 33. Each of the spring seats 33 includes an inclined member 34, a gap body 35, and a receiving member 36. The inclined member 34 is positioned on the axle box 9, and an upper surface of the inclined member 34 is inclined toward a longitudinal direction middle side. The gap body 35 is positioned on the inclined member 34 and has elasticity. The receiving member 36 is positioned on the gap body 35, and the end portion 30*b* of the plate spring 30 is placed on the receiving member 36. Upper surfaces of the end portions 30*b* of each of the plate springs 30 are inclined in a direction toward the middle portion 30*a*. The middle portion 30*a* of the plate spring is pressed against the lower surface 31*b* (see FIG. 4) of the pressing member 31 and has a circular-arc shape. To be specific, the middle portion 30*a* is located under the end portions 30*b*, and the entire plate spring 30 has a bow shape that is convex downward in a side view.

The axle boxes 9 are coupled to the car width direction end portions 5*a* of the cross beam 5 by coupling devices 15 serving as axle box suspensions. Each of the coupling devices 15 includes axle beams 16, a pair of receiving seats 17 and 18, and coupling portions 19. Each of the axle beams 16 projects integrally from the axle box 9 toward the cross beam 5. The receiving seats 17 and 18 project from the cross beam 5 toward the axle beams 16. Each of the coupling portions 19 couples a tip end portion 16*a* of the axle beam 16 to the receiving seats 17 and 18. To be specific, the coupling device 15 of the present embodiment is an axle beam type device.

A tubular portion 21 is provided at the tip end portion 16*a* of the axle beam 16. An inner peripheral surface of the tubular portion 21 has a cylindrical shape, and both lateral direction sides of the tubular portion 21 are open. A core rod 22 is inserted through an internal space of the tubular portion 21 via a rubber bushing (not shown). Fitting grooves 17*c* are formed on the receiving seats 17 and 18 so as to be open downward. Both lateral direction end portions of the core rod 22 are fitted in the respective fitting grooves 17*c* from below. In this state, a lid member 19*a* constituting a part of the coupling portion 19 is fixed to the receiving seats 17 and 18 by bolts (not shown) from below so as to close lower openings of the fitting grooves 17*c*. Thus, the core rod 22 is supported by the lid member 19*a* from below. A part of the plate spring 30 is arranged at a position overlapping the receiving seats 17 and 18 in a side view. The plate spring 30 is arranged so as to be spaced apart from the receiving seats 17 and 18. The plate spring 30 extends through a space between the receiving seats 17 and 18 to a position under the cross beam 5.

Figure 4:
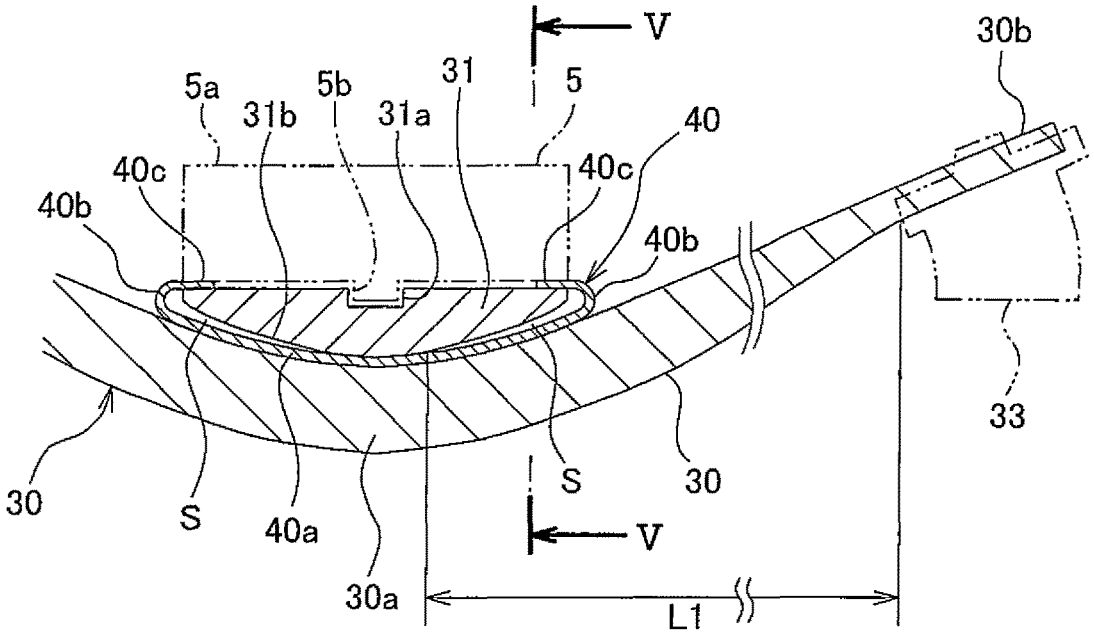
FIG. 4 is a major portion cross-sectional view taken along line IV-IV of FIG. 2 and shows a plate spring, a pressing member, and a flexible cover in an empty car state.
Figure 5:
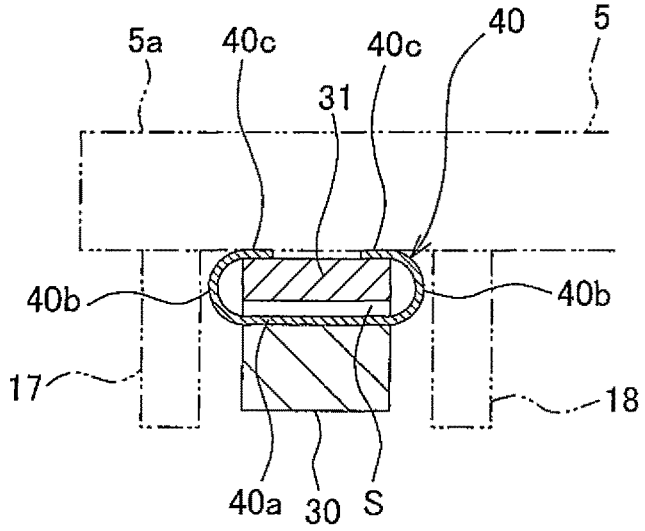
FIG. 5 is a cross-sectional view taken along line V-V of FIG. 4.

FIG. 4 is a major portion cross-sectional view taken along line IV-IV of FIG. 2 and shows the plate spring 30, the pressing member 31, and a flexible cover in an empty car state. FIG. 5 is a cross-sectional view taken along line V-V of FIG. 4. As shown in FIGS. 4 and 5, the pressing member 31 is provided under the car width direction end portion 5*a* of the cross beam 5. The pressing member 31 is constituted by a stiff member (for example, an inelastic member made of metal, fiber-reinforced resin, or the like). The pressing member 31 is placed on the middle portion 30*a* of the plate spring 30 from above. The pressing member 31 does not support the lower surface of the plate spring 30, that is, the lower surface of the plate spring 30 is in an exposed state. In other words, the pressing member 31 is not fixed to the plate spring 30 in the upper/lower direction and presses the upper surface of the plate spring 30 downward so as to be separable from the upper surface of the plate spring 30. To be specific, the pressing member 31 is not fixed to the plate spring 30 by fixtures, and the pressing of the pressing member 31 against the upper surface of the plate spring 30 is maintained by the downward load from the cross beam 5 due to gravity and the reaction force of the plate spring 30 against the downward load. Therefore, the pressing member 31 allows the plate spring 30 to swing relative to the lower surface 31*b* of the pressing member 31 while changing a pressed region of the plate spring 30, the pressed region being pressed by the pressing member 31.

Fitting portions 5*b* constituted by convex portions are formed on respective lower surfaces of the end portions 5*a* of the cross beam 5, and fitted portions 31*a* in which the fitting portions 5*b* are fitted are formed on the respective upper surfaces of the pressing members 31. The lower surface 31*b* which presses the plate spring 30 has a circular-arc shape that is convex downward when viewed from one side that is a direction (car width direction) perpendicular to the longitudinal direction of the plate spring 30. An upper surface of the middle portion 30*a* which is pressed by the pressing member 31 also has a circular-arc shape that is convex downward when viewed from one side that is a direction (car width direction) perpendicular to the longitudinal direction of the plate spring 30.

In a state where the bogie 1 is not supporting the carbody (not shown), the curvature of the lower surface 31*b* of the pressing member 31 is larger than the curvature of the upper surface of the middle portion 30*a* of the plate spring 30. In a state where the bogie 1 is supporting the carbody (not shown), the plate spring 30 elastically deforms by the downward load from the carbody (not shown) such that the cross beam 5 moves downward. Thus, the curvature of the middle portion 30*a* of the plate spring 30 increases. However, when the car is empty, that is, when no passengers are in the carbody (not shown), the curvature of the lower surface 31*b* of the pressing member 31 is maintained to be larger than the curvature of the middle portion 30*a* of the plate spring 30. Therefore, a space S is formed between the lower surface 31*b* of the pressing member 31 and the upper surface of the middle portion 30*a* of the plate spring 30 so as to be located at both longitudinal direction sides of a lowermost end of the pressing member 31.

Further, the space S is formed, so that even in a case where a difference in height between the front and rear wheels is generated by, for example, track irregularity, a contact point where the lower surface 31*b* of the pressing member 31 and the upper surface of the plate spring 30 contact each other can be moved in the longitudinal direction of the plate spring 30. Therefore, the followability to the track can be improved. With this, a wheel load variation due to the track irregularity and the like can be suppressed, and the running safety can be improved. In addition, the swinging of the cross beam 5 can be suppressed, so that the ride quality can be prevented from deteriorating.

The bogie 1 is provided with a flexible cover 40 covering the space S. The flexible cover 40 is formed by, for example, a rubber sheet. The flexible cover 40 integrally includes a buffer portion 40*a*, a cover portion 40*b*, and an attaching portion 40*c*. The buffer portion 40*a* is sandwiched between the lower surface 31*b* of the pressing member 31 and the upper surface of the middle portion 30*a* of the plate spring 30. The cover portion 40*b* covers the space S from a horizontal direction outer side of the space S. The attaching portion 40*c* is sandwiched between the cross beam 5 and the pressing member 31. The buffer portion 40*a* serves as a buffer which protects the upper surface of the plate spring 30 from the pressing member 31. The cover portion 40*b* covers both car width direction sides and both car longitudinal direction sides of the space S between the pressing member 31 and the plate spring 30 and curves so as to expand outward. The cover portion 40*b* prevents foreign matters from getting into the space S. A portion of the cover portion 40*b* which covers both car width direction sides of the space S and a portion of the cover portion 40*b* which covers both car longitudinal direction of the space S are continuously formed in the horizontal direction but may be formed separately. The attaching portion 40*c* is compressed and held by being sandwiched between the cross beam 5 and the pressing member 31.

Figure 6:
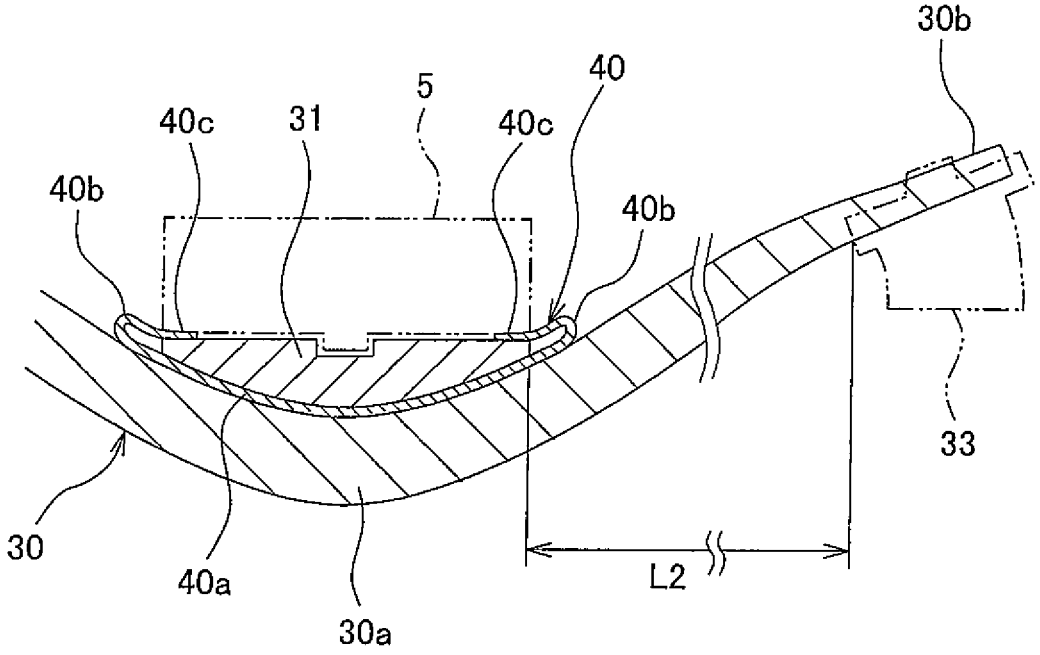
FIG. 6 is a diagram corresponding to FIG. 4 and shows the plate spring, the pressing member, and the flexible cover in a full car state.

FIG. 6 is a diagram corresponding to FIG. 4 and shows the plate spring 30, the pressing member 31, and the flexible cover 40 in a full car state. As shown in FIG. 6, as the number of passengers in the carbody (not shown) increases, and this increases the downward load applied to the cross beam 5, the curvature of the middle portion 30*a* of the plate spring 30 pressed downward by the pressing member 31 increases. To be specific, as the downward load applied to the cross beam 5 increases, the plate spring 30 elastically deforms, and an area pressed by the pressing member 31 increases. Thus, a shortest distance between the pressed region of the plate spring 30 which is pressed by the pressing member 31 and a supported region of the plate spring 30 which is supported by the spring seat 33 decreases from a distance L1 (FIG. 4) to a distance L2 (FIG. 6). With this, as the occupancy rate of the carbody (not shown) increases, and this increases the downward load applied to the cross beam 5, the spring constant of the plate spring 30 increases. When the downward load applied to the cross beam 5 increases, and this increases the curvature of the middle portion 30*a* of the plate spring 30, the cover portion 40*b* of the flexible cover 40 flexibly deforms to keep covering the space S from outside.

According to the configuration explained above, the pressing members 31 provided at both respective car width direction end portions 5*a* of the cross beam 5 are placed on the respective car longitudinal direction middle portions 30*a* of the plate springs 30 from above. Therefore, a support structure between the plate spring 30 and the cross beam 5 is simplified, and assembly workability of the bogie 1 significantly improves. Further, the curvature of the lower surface 31*b* of the pressing member 31 which presses the plate spring 30 is larger than the curvature of the upper surface of the middle portion 30*a* of the plate spring 30 which is pressed by the pressing member 31. Therefore, as the number of passengers in the car increases, and this increases the downward load applied to the cross beam 5, the distance L1, L2 between the pressed region of the plate spring 30 which is pressed by the pressing member 31 and the supported region of the plate spring 30 which is supported by the spring seat 33 shortens by the elastic deformation of the plate spring 30. Thus, the spring constant of the plate spring 30 increases. Therefore, the car in which the spring constant changes in accordance with the change in the occupancy rate and which has good ride quality both when the occupancy rate is low and when the occupancy rate is high can be realized.

Further, according to the above configuration, the space S is formed between the lower surface 31*b* of the pressing member 31 and the upper surface of the middle portion 30*a* of the plate spring 30 so as to be located at both longitudinal direction sides of the lowermost end of the pressing member. Therefore, even in a case where the difference in height between the front and rear wheels is generated by, for example, the track irregularity, the contact point where the lower surface 31*b* of the pressing member 31 and the upper surface of the plate spring 30 contact each other can be moved in the longitudinal direction of the plate spring 30. Therefore, the followability to the track can be improved. With this, the wheel load variation due to the track irregularity and the like can be suppressed, and the running safety can be improved. In addition, the swinging of the cross beam 5 can be suppressed, so that the ride quality can be prevented from deteriorating.

Second Embodiment

Figure 7:
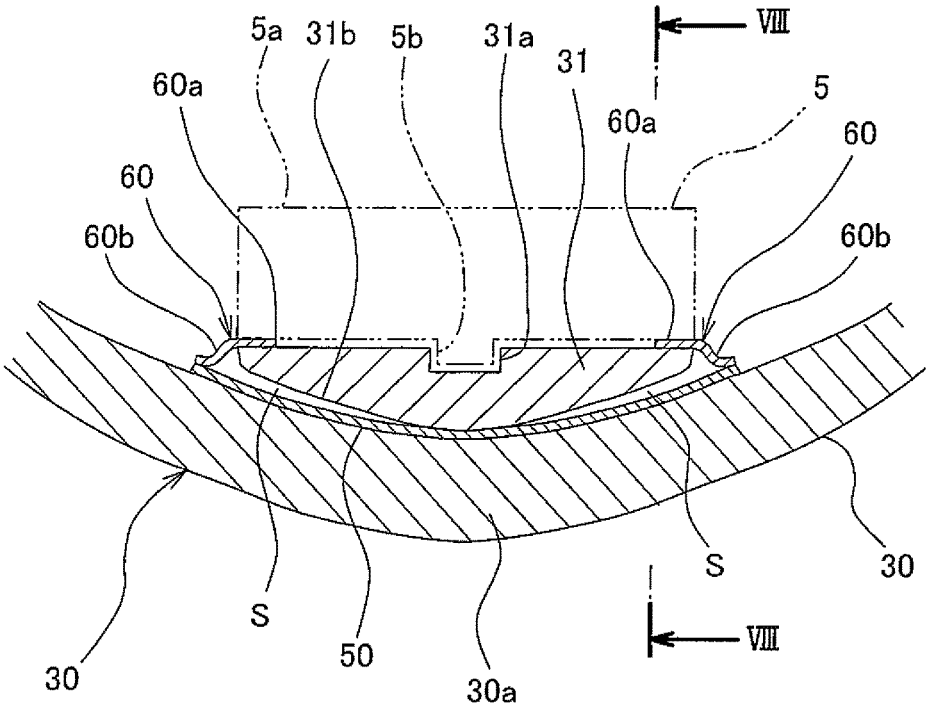
FIG. 7 is a diagram corresponding to FIG. 4 and shows the railcar bogie according to a second embodiment.
Figure 8:
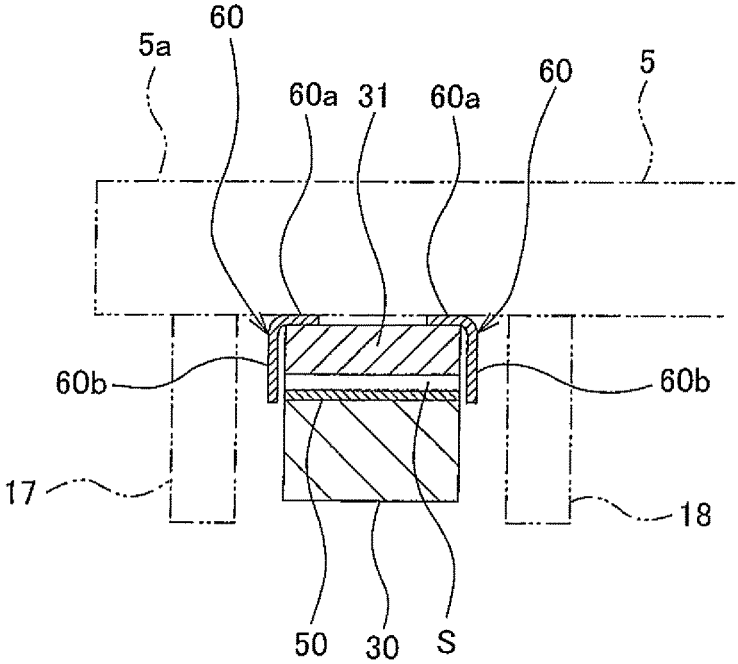
FIG. 8 is a cross-sectional view taken along line VIII-VIII of FIG. 7.

FIG. 7 is a diagram corresponding to FIG. 4 and shows the railcar bogie according to the second embodiment. FIG. 8 is a cross-sectional view taken along line VIII-VIII of FIG. 7. As shown in FIGS. 7 and 8, a buffer sheet 50 is sandwiched between the lower surface 31*b* of the pressing member 31 and the middle portion 30*a* of the plate spring 30. The buffer sheet 50 is, for example, a rubber sheet. A flexible cover 60 is a rubber sheet formed separately from the buffer sheet 50. The flexible cover 60 integrally includes an attaching portion 60*a* and a cover portion 60*b*. The attaching portion 60*a* is sandwiched between the cross beam 5 and the pressing member 31. The cover portion 60*b* covers the space S between the pressing member 31 and the middle portion 30*a* of the plate spring 30 from the horizontal direction outer side. A lower end portion of a portion, which covers both car longitudinal direction sides of the space S, of the cover portion 60*b* is placed on the buffer sheet 50 or the upper surface of the plate spring 30. A portion of the cover portion 60*b* which covers both car width direction sides of the space S hangs down by its own weight in a space between the plate spring 30 and the receiving seat 17, 18. The portion of the cover portion 60*b* which covers both car width direction sides of the space S and the portion of the cover portion 60*b* which covers both car longitudinal direction sides of the space S are formed separately in the horizontal direction but may be formed continuously. It should be noted that the same reference signs are used for the same components as in the first embodiment, and explanations thereof are omitted.

Third Embodiment

Figure 9:
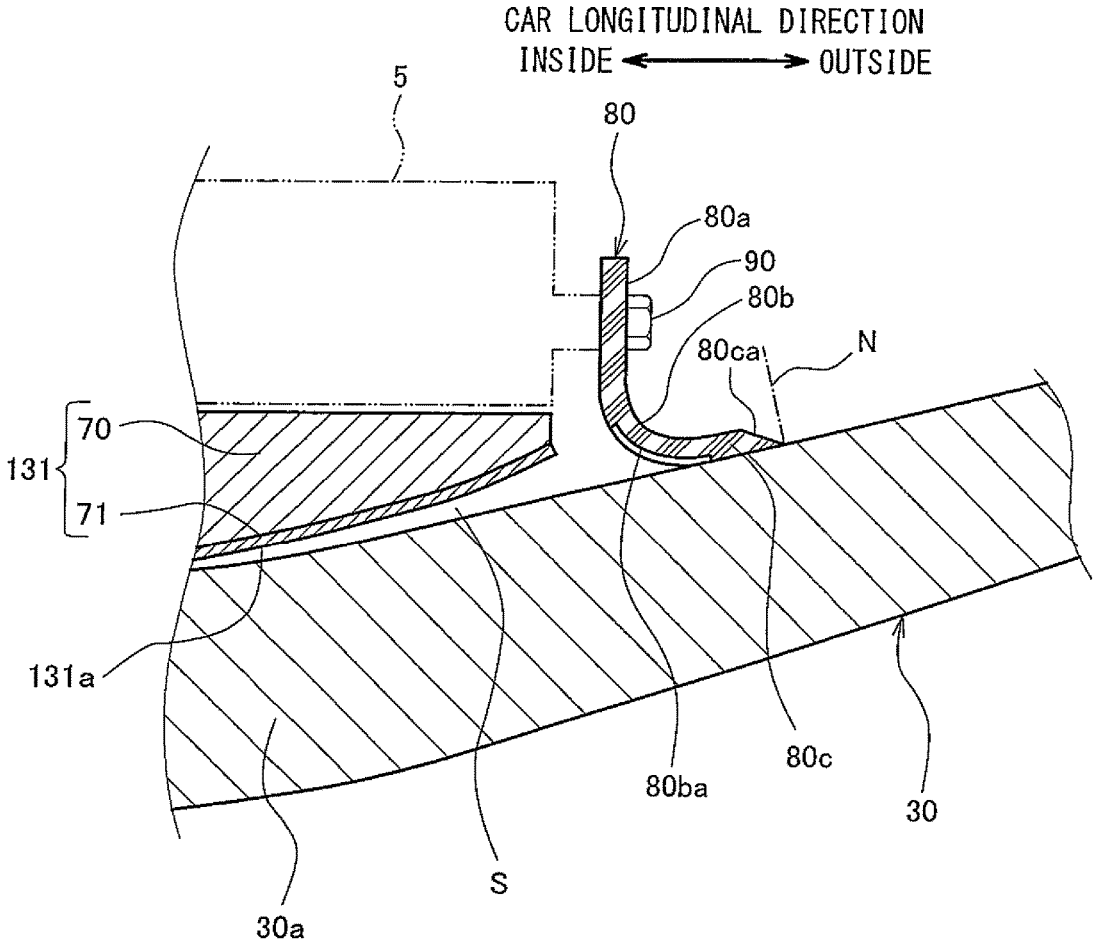
FIG. 9 is a cross-sectional view of major portions of the railcar bogie according to a third embodiment.
Figure 10:
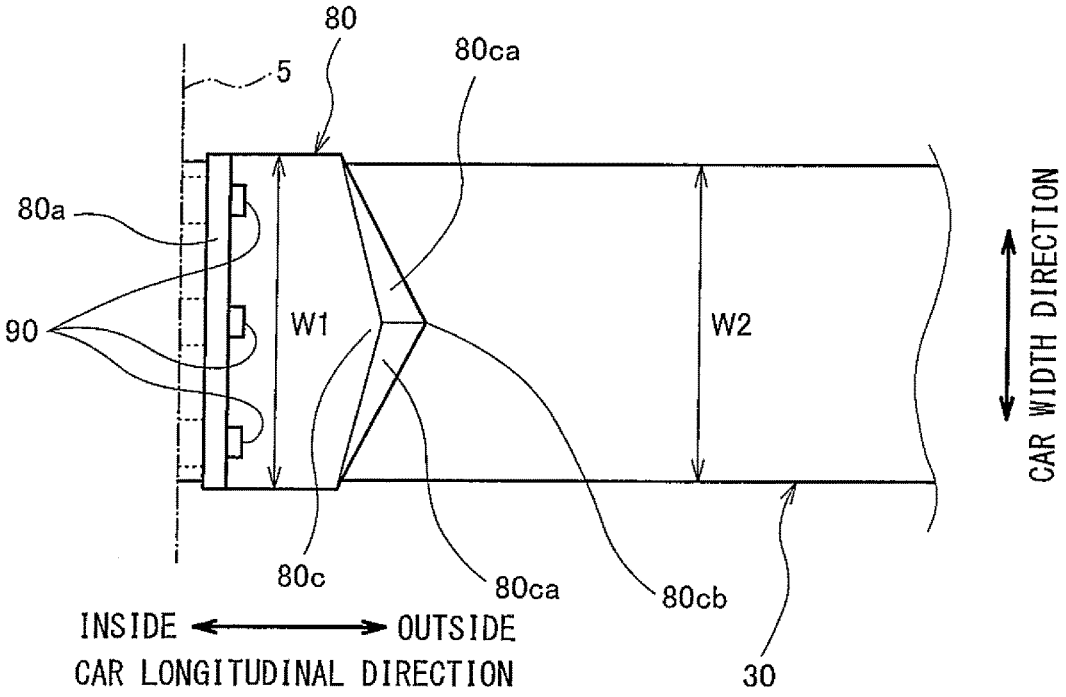
FIG. 10 is a plan view of the major portions of FIG. 9 when viewed from above.

FIG. 9 is a cross-sectional view of major portions of the railcar bogie according to the third embodiment. FIG. 10 is a plan view of the major portions of FIG. 9 when viewed from above. As shown in FIGS. 9 and 10, in the bogie of the present embodiment, pressing members 131 are provided under both respective car width direction end portions of the cross beam 5. Each of the pressing members 131 includes a circular-arc lower surface 131*a* that is convex downward in a side view. The pressing member 131 is placed on the longitudinal direction middle portion 30*a* of the plate spring 30 from above. The pressing member 131 includes a main body portion 70 and an elastic sheet 71 (for example, a rubber sheet). The main body portion 70 is made of a rigid body (for example, metal) and includes a circular-arc lower surface that is convex downward in a side view. The elastic sheet 71 is attached to the lower surface of the main body portion 70. To be specific, the lower surface 131*a* of the pressing member 131 is a lower surface of the elastic sheet 71. In a side view, the curvature of the lower surface 131*a* of the pressing member 131 is larger than the curvature of the middle portion 30*a* of the plate spring 30, and the space S is formed between the lower surface 131*a* of the pressing member 131 and the upper surface of the middle portion 30*a* of the plate spring 30 so as to be located at both longitudinal direction sides of a lowermost end of the pressing member 131.

Flexible covers 80 are provided at the cross beam 5. Each of the flexible covers 80 covers the space S from a car longitudinal direction outer side. The flexible cover 80 is formed by an elastic plate (for example, a rubber plate) and is flat in a no-load state (before the flexible cover 80 is attached to the bogie). The flexible cover 80 includes an attaching portion 80*a*, a bent portion 80*b*, and an end portion 80*c*. The attaching portion 80*a* is attached to the cross beam 5 by fixtures 90 (for example, bolts). The bent portion 80*b* is downwardly continuous with the attaching portion 80*a* and is bent toward the car longitudinal direction outer side by a bending load. The end portion 80*c* is continuous with the bent portion 80*b* toward the car longitudinal direction outer side and tightly contacts a portion of the upper surface of the plate spring 30, the portion being located at the car longitudinal direction outer side of the space S. To be specific, in a state where the flexible cover 80 is bent more than the non-load state, the end portion 80*c* is pressed against the upper surface of the plate spring 30. By elastic repulsive force by which the bent portion 80*b* tries to return to an original shape, the end portion 80*c* tightly contacts the upper surface of the plate spring 30.

The flexible cover 80 has a shape symmetrical to the car width direction. A width W1 of the flexible cover 80 in the car width direction is not less than a width W2 of the plate spring 30 in the car width direction. In a plan view, the end portion 80*c* of the flexible cover 80 has a shape that is tapered toward the car longitudinal direction outer side. In a plan view, an end edge of the flexible cover 80 has a linearly pointed shape. However, the end edge of the flexible cover 80 may have a shape that is tapered so as to have a curved shape. In a side view, an end surface 80*ca* of the end portion 80*c* of the flexible cover 80 which is located at the car longitudinal direction outer side is inclined toward a car longitudinal direction inner side relative to a normal line N of a portion of the upper surface of the plate spring 30, the portion being located at the end edge of the end portion 80*c*. To be specific, the end surface 80*ca* of the flexible cover 80 is formed as a slope connecting the upper surface of the plate spring 30 and the upper surface of the flexible cover 80. An inclination angle of the end surface 80*ca* relative to the normal line N is set to increase in a direction from a width direction outer side of the flexible cover 80 toward a width direction middle side of the flexible cover 80.

The bent portion 80*b* of the flexible cover 80 is partially reduced in thickness. Specifically, a concave portion 80*ba* is formed on a lower surface of the bent portion 80*b*. The concave portion 80*ba* extends to a portion of the flexible cover 80, the portion contacting the plate spring 30. The thickness of the bent portion 80*b* at the concave portion 80*ba* is smaller than the thickness of each of the attaching portion 80*a* and the end portion 80*c*. The concave portion 80*ba* has a shape symmetrical to the car width direction. The concave portion 80*ba* has a closed shape in a plan view. The concave portion 80*ba* is arranged such that a car width direction position thereof becomes the same as the car width direction position of a tip end 80*cb* of the end portion 80*c* having a tapered shape.

According to the above configuration, the flexible cover 80 covers the car longitudinal direction outer side of the space S between the pressing member 131 and the plate spring 30, and the end portion 80*c* of the flexible cover 80 elastically and tightly contacts the upper surface of the plate spring 30. Therefore, foreign matters can be effectively prevented from getting into the space S. In a plan view, the end portion 80*c* of the flexible cover 80 has a shape that is tapered toward the car longitudinal direction outer side. Therefore, when the foreign matters on the upper surface of the plate spring 30 having a bow shape that is convex downward move from the car longitudinal direction outer side toward the flexible cover 80, the end portion 80*c* of the flexible cover 80 can cause the foreign matters to smoothly move toward the car width direction outer side of the plate spring 30.

The end portion 80*c* of the flexible cover 80 includes the end surface 80*ca* that is inclined toward the car longitudinal direction inner side relative to the normal line N of the upper surface of the plate spring 30 in a side view. Therefore, when the foreign matters on the upper surface of the plate spring 30 move from the car longitudinal direction outer side toward the flexible cover 80, the end portion 80*c* of the flexible cover 80 can smoothly discharge the foreign matters from the upper surface of the plate spring 30 to outside along the end surface 80*ca*. The bent portion 80*b* of the flexible cover 80 is partially reduced in thickness by the concave portion 80*ba*. Therefore, the tip end 80*cb* of the flexible cover 80 can be prevented from floating up from the upper surface of the plate spring 30. Since the other components are the same as those of the first embodiment, explanations thereof are omitted.

Fourth Embodiment

Figure 11:
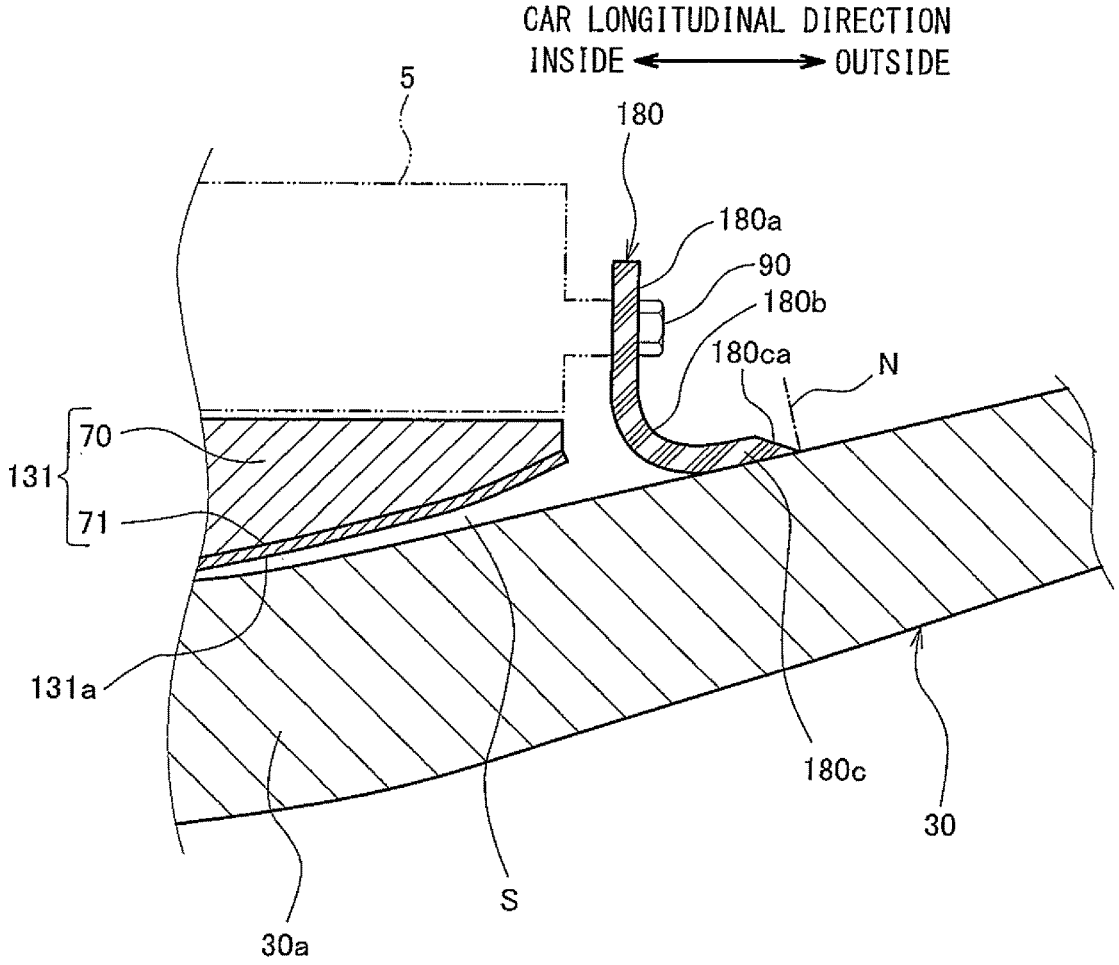
FIG. 11 is a cross-sectional view of the major portions of the railcar bogie according to a fourth embodiment.
Figure 12:
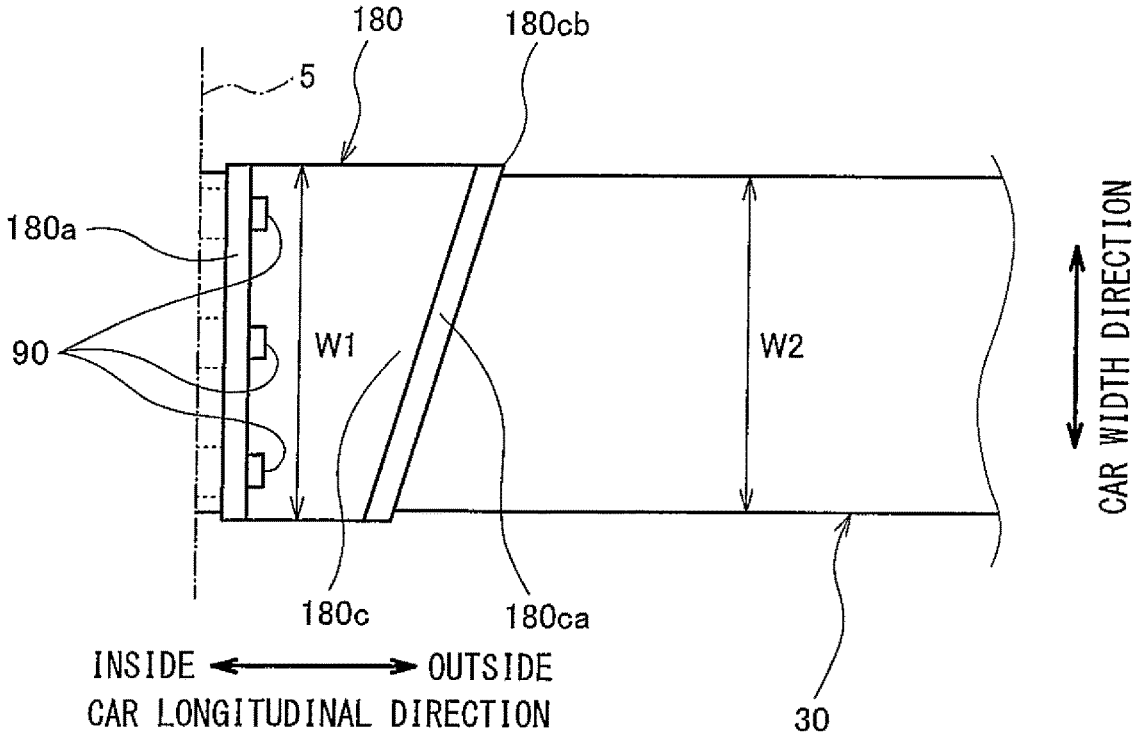
FIG. 12 is a plan view of the major portions of FIG. 11 when viewed from above.

FIG. 11 is a cross-sectional view of the major portions of the railcar bogie according to the fourth embodiment. FIG. 12 is a plan view of the major portions of FIG. 11 when viewed from above. The same reference signs are used for the same components as in the third embodiment, and explanations thereof are omitted. As shown in FIGS. 11 and 12, flexible covers 180 are provided at the cross beam 5. Each of the flexible covers 180 covers the space S from the car longitudinal direction outer side. The flexible cover 180 is formed by an elastic plate (for example, a rubber plate) and is flat in the no-load state (before the flexible cover 180 is attached to the bogie). The flexible cover 180 includes an attaching portion 180*a*, a bent portion 180*b*, and an end portion 180*c*. The attaching portion 180*a* is attached to the cross beam 5 by fixtures 90 (for example, bolts). The bent portion 180*b* is downwardly continuous with the attaching portion 180*a* and is bent toward the car longitudinal direction outer side by the bending load. The end portion 180*c* is continuous with the bent portion 180*b* toward the car longitudinal direction outer side and tightly contacts a portion of the upper surface of the plate spring 30, the portion being located at the car longitudinal direction outer side of the space S.

In a plan view, the end portion 180*c* of the flexible cover 180 has a shape that is tapered toward the car longitudinal direction outer side. Specifically, a car longitudinal direction end edge of the flexible cover 180 has a tapered shape that is inclined relative to the car width direction in a plan view. The car longitudinal direction end edge of the flexible cover 180 is linearly inclined from one of car width direction ends thereof to the other end thereof. To be specific, a car longitudinal direction tip end 180*cb* of the flexible cover 180 is located at one of car width direction ends of the flexible cover 180. In the present embodiment, the tip end 180*cb* of the flexible cover 180 is located at the car width direction outer side of the plate spring 30. In a side view, an end surface 180*ca* of the end portion 180*c* of the flexible cover 180 which is located at the car longitudinal direction outer side is inclined toward the car longitudinal direction inner side relative to the normal line N of a portion of the upper surface of the plate spring 30, the portion being located at the end edge of the end portion 180*c*. The bent portion 180*b* of the flexible cover 180 does not include a portion such as the concave portion 80*b* of the third embodiment. The bent portion 180*b* has a uniform thickness.

According to the above configuration, as with the third embodiment, the flexible cover 180 can effectively prevent the foreign matters from getting into the space S.

The present invention is not limited to the above embodiments, and modifications, additions, and eliminations may be made within the scope of the present invention. For example, the flexible covers 40, 60, 80, and 180 are only required to be flexible. Each of the flexible covers 40, 60, 80, and 180 may be a cloth having no elasticity. The flexible cover 40, 60, 80, 180 may be attached to the pressing member 31, 131 or the cross beam 5. The attaching portion 40*c*, 60*a*, 80*a*, 180*a* of the flexible cover 40, 60, 80, 180 may be fixed by adhesion or the like to the cross beam 5 to which the pressing member 31, 131 is attached or may be engaged with the pressing member 31, 131 or the cross beam 5. The pressing member 31, 131 is formed separately from the cross beam 5 but may be formed integrally with the cross beam 5 by welding.

INDUSTRIAL APPLICABILITY

As above, the railcar bogie according to the present invention has the above-described excellent effects. It is useful to widely apply the present invention to railcar bogies that can achieve the significance of those effects.

REFERENCE SIGNS LIST

1 bogie
5 cross beam
6 axle
8 bearing
9 axle box
30 plate spring
31, 131 pressing member
40, 60, 80, 180 flexible cover
40*a* buffer portion
40*b*, 60*b* cover portion
40*c*, 60*a*, 80*a*, 180*a* attaching portion
80*c*, 180*c* end portion
80*ca*, 180*ca* end surface

The invention claimed is:

1. A railcar bogie comprising:
a cross beam supporting a carbody of a railcar;
a pair of axles arranged at both respective sides of the cross beam in a car longitudinal direction and extending in a car width direction;
bearings provided at both car width direction sides of each of the axles and rotatably supporting the axles;
axle boxes accommodating the respective bearings;
plate springs supporting both respective car width direction end portions of the cross beam and extending in the car longitudinal direction, both car longitudinal direction end portions of each of the plate springs being supported by the respective axle boxes; and
pressing members located at both respective car width direction end portions of the cross beam and placed on respective car longitudinal direction substantially middle portions of the plate springs,
a lower surface of a portion of each of the pressing members having a circular-arc shape that is convex downward in a side view, the portion pressing the plate spring,
an upper surface of a portion of each of the plate springs having the circular-arc shape that is convex downward in the side view, the portion being pressed by the pressing member, and
a curvature of the lower surface of the pressing member being larger than the curvature of the upper surface of the plate spring.

2. The railcar bogie according to claim 1, further comprising a flexible cover covering a space between the lower surface of the pressing member and the upper surface of the plate spring, the space arising from a difference between the curvature of the lower surface of the pressing member and the curvature of the upper surface of the plate spring.

3. The railcar bogie according to claim 2, wherein the flexible cover covers at least both car longitudinal direction sides of the space.

4. The railcar bogie according to claim 2, wherein the flexible cover is attached to the pressing member or the cross beam to which the pressing member is attached.

5. The railcar bogie according to claim 2, wherein the flexible cover integrally includes:
a buffer portion between the lower surface of the pressing member and the upper surface of the plate spring; and
a cover portion covering the space from a horizontal direction outer side of the space.

6. The railcar bogie according to claim 2, wherein the flexible cover elastically and tightly contacts a portion of the upper surface of the plate spring, the portion being located at a car longitudinal direction outer side of the space.

7. The railcar bogie according to claim 1, wherein the pressing members are not fixed by fixtures to the plate springs, thereby allowing the plate springs to move relative to the pressing members.

8. A railcar bogie comprising:
a cross beam supporting a carbody of a railcar;
a pair of axles arranged at both respective sides of the cross beam in a car longitudinal direction and extending in a car width direction;
bearings provided at both car width direction sides of each of the axles and rotatably supporting the axles;
axle boxes accommodating the respective bearings;
plate springs supporting both respective car width direction end portions of the cross beam and extending in the car longitudinal direction, both car longitudinal direction end portions of each of the plate springs being supported by the respective axle boxes; and
pressing members located at both respective car width direction end portions of the cross beam and placed on respective car longitudinal direction substantially middle portions of the plate springs, wherein:
a lower surface of a portion of each of the pressing members has a circular-arc shape that is convex downward in a side view, the portion pressing the plate spring,
an upper surface of a portion of each of the plate springs has the circular-arc shape that is convex downward in the side view, the portion being pressed by the pressing member,
a curvature of the lower surface of the pressing member is larger than the curvature of the upper surface of the plate spring,
the railcar bogie further comprises a flexible cover covering a space between the lower surface of the pressing member and the upper surface of the plate spring, the space arising from a difference between the curvature of the lower surface of the pressing member and the curvature of the upper surface of the plate spring,
the flexible cover elastically and tightly contacts a portion of the upper surface of the plate spring, the portion being located at a car longitudinal direction outer side of the space,
an end portion of the flexible cover elastically and tightly contacts the upper surface of the plate spring, the end portion being located at the car longitudinal direction outer side, and
the end portion of the flexible cover has a shape that is tapered toward the car longitudinal direction outer side in a plan view.

9. A railcar bogie comprising:
a cross beam supporting a carbody of a railcar;
a pair of axles arranged at both respective sides of the cross beam in a car longitudinal direction and extending in a car width direction;
bearings provided at both car width direction sides of each of the axles and rotatably supporting the axles;
axle boxes accommodating the respective bearings;

plate springs supporting both respective car width direction end portions of the cross beam and extending in the car longitudinal direction, both car longitudinal direction end portions of each of the plate springs being supported by the respective axle boxes; and pressing members located at both respective car width direction end portions of the cross beam and placed on respective car longitudinal direction substantially middle portions of the plate springs, wherein:

a lower surface of a portion of each of the pressing members has a circular-arc shape that is convex downward in a side view, the portion pressing the plate spring, an upper surface of a portion of each of the plate springs has the circular-arc shape that is convex downward in the side view, the portion being pressed by the pressing member, a curvature of the lower surface of the pressing member is larger than the curvature of the upper surface of the plate spring, the railcar bogie further comprises a flexible cover covering a space between the lower surface of the pressing member and the upper surface of the plate spring, the space arising from a difference between the curvature of the lower surface of the pressing member and the curvature of the upper surface of the plate spring, the flexible cover elastically and tightly contacts a portion of the upper surface of the plate spring, the portion being located at a car longitudinal direction outer side of the space, an end portion of the flexible cover elastically and tightly contacts the upper surface of the plate spring, the end portion being located at the car longitudinal direction outer side, and the end portion of the flexible cover includes an end surface that is inclined toward a car longitudinal direction inner side relative to a normal line of the upper surface of the plate spring in a side view.

* * * * *